US005163684A

United States Patent [19]

Seidler

[11] Patent Number: 5,163,684

[45] Date of Patent: Nov. 17, 1992

[54] CHIP SHOT PRACTICE RING

[76] Inventor: Joseph C. Seidler, 1111 Hentschel Pl., St. Louis, Mo. 63135

[21] Appl. No.: 843,167

[22] Filed: Feb. 28, 1992

[51] Int. Cl.[5] ..... A63B 69/36

[52] U.S. Cl. ..... 273/181 A; 273/177 R; 273/407; 273/371; 273/183.1

[58] Field of Search ..... 273/181 R, 181 A, 181 E, 273/181 F, 181 G, 181 H, 181 J, 181 K, 182 R, 182 A, 177 R, 177 A, 177 B, 178 R, 178 A, 178 B, 179 R, 179 A, 179 B, 179 C, 179 D, 179 E, 180, 176 FA, 176 B, 407, 371, 398

[56] References Cited

U.S. PATENT DOCUMENTS 3,104,879 9/1963 Jetton ..... 273/177 A X
3,540,734 11/1970 Temple ..... 273/181 A

*Primary Examiner*—George J. Marlo
*Attorney, Agent, or Firm*—E. Michael Combs

[57] ABSTRACT

A chip shot practice ring utilized as a target and receptacle for receiving chipped or pitched golf balls is disclosed. The apparatus utilizes a substantially circular base member constructed of a rectangular strip of material joined at its opposite abutting ends by a closure member. A vertically oriented flag pole is attached at its lower end to a vertically extending pole in the closure member, and a flag is attached to the flag pole at its upper end. The components of the apparatus are fabricated from brightly colored polymeric and metallic materials which enhance their visibility, portability, and resistance to material degradation. A lighting assembly, including a bulb on the flag pole and a fiber optic cable extending to and around the upper surface of the base member, is further provided to illuminate the base member, the flag pole, and the flag to render the apparatus highly visible to the practicing golfer under minimal lighting conditions.

10 Claims, 4 Drawing Sheets

102
105
98
100
106
130
108
19
124
110
118
88
13
72'
74'
64
12
12
90
88
14
36
84

88
86
84
83

CHIP SHOT PRACTICE RING

BACKGROUND OF THE INVENTION

1. Field of the Invention

The field of the invention relates to game target apparatus, and more particularly to a golf chip shot practice ring which is configured to provide a highly visible, portable, and simple target-type receptacle into which golf balls ma be repetitively chipped or pitched to quantitatively measure and thereby maximize the accuracy of a golfer's chip shots.

2. Description of the Prior Art

The sport of golfing continues to be an extremely popular activity both at the professional and amateur levels. Almost every participant in the sport seeks both methods, in the form of advice, as well as physical learning devices to improve the efficiency of his or her particular game. One important aspect of the sport to achieve that result is the perfection of short range or "chip" shots which are intended to place the ball as close as possible, or ideally into, a given hole. In the past, golfers simply hit random shots in open areas, both indoors and outdoors, used practice holes dug in outdoor home yard areas which define a miniature course, practiced at commercial driving ranges or miniature golf courses, or chipped balls into improvised holes or targets such as laundry baskets or open-ended cans.

Various game targets have been utilized in the prior art. For example, U.S. Pat. No. 3,595,583 to Oppenheimer discloses a golf swing training device including structure attachable to the golfer's body to develop proper club swinging movements to perfect accurate driving of the balls in both distance and direction.

U.S. Pat. No. 3,655,203 to Gretzky discloses another target apparatus for games such as golf comprising a series of broad tape sections made of reflective material upon which target images may be projected. Each of the target sections is further longitudinally split into a plurality of narrow sections to provide a penetrable target screen.

U.S. Pat. No. 4,407,505 to Kendziorski illustrates a portable target for driven golf balls comprising a segmented flagstaff and flag which is easily collapsed for transport and subsequent reassembly into its operable configuration in any desired location using its ground spike element.

U.S. Pat. No. 4,630,832 to Swenson provides a game target apparatus having means for sensing the impact of a game projectile against the target to effect automatic scoring and thus a more efficient and timely indication of performance and enhancement of skill in the game.

As such, it may be appreciated that there continues to be a need for a new and improved chip shot practice ring which addresses both the problems of ease of use, portability, and effectiveness in construction, and in this respect, the present invention substantially fulfills this need.

SUMMARY OF THE INVENTION

In view of the foregoing disadvantages inherent in the known types of game target apparatus now present in the prior art, the present invention provides a chip shot practice ring wherein the same utilizes a highly visible combination of a base member and a flag pole and flag assembly attached to said base member which functions as a target and a receptacle for receiving chipped golf balls. As such, the general purpose of the present invention which will be described subsequently in greater detail, is to provide a new and improved chip shot practice ring which has all the advantages of the prior art game target apparatus and none of the disadvantages.

To attain this, the present invention includes a chip shot practice ring utilized as a target and receptacle for receiving chipped or pitched golf balls is set forth. The device utilizes a substantially circular base member constructed of a rectangular strip of material joined at its opposite ends by a closure member. A vertically oriented flag pole is attached at its lower end to the closure member, and a flag is attached to the flag pole at its upper end. Means are further provided to illuminate the base member, flag pole, and the flag to render the device highly visible to the practicing golfer.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved chip shot practice ring which has all the advantages of the prior art game target apparatus and none of the disadvantages.

It is another object of the present invention to provide a new and improved chip shot practice ring which may be easily and efficiently manufactured and marketed.

It is a further object of the present invention to provide a new and improved chip shot practice ring which is of durable and reliable construction.

An even further object of the present invention is to provide a new and improved chip shot practice ring which is susceptible of a low cost of manufacture with regard to both materials and labor, and which accordingly is then susceptible of low prices of sale to the consuming public, thereby making such chip shot practice rings economically available to the buying public through golf pro shops, sporting goods stores, as well as appropriate magazines and publications. Further, its modest cost will encourage golfers to purchase several practice rings to set up miniature courses which eliminate unproductive walking between shots.

Still yet another object of the present invention is to provide a new and improved chip shot practice ring which provides in the apparatuses and methods of the prior art some of the advantages thereof, while simultaneously overcoming some of the disadvantages normally associated therewith.

Still another object of the present invention is to provide a new and improved chip shot practice ring wherein the same provides a specific target for driven golf balls which is thus more effective in honing the skill of a golfer's game than simply hitting random shots in an open area.

Yet another object of the present invention is to provide a new and improved chip shot practice ring which provides a quantitative measuring means of chip shot accuracy including the judgement on near misses enabling the golfer to more readily develop a "feel" for the proper arc length and swing speed required to drive a ball the required distance to a given hole.

Even still another object of the present invention is to provide a new and improved chip shot practice ring which is readily transportable to any desired location such as a player's back yard which eliminates frequent and unproductive trips to a practice range or golf course.

Still another object of the present invention is to provide a new and improved chip shot practice ring which is brightly colored and illuminated to enhance target visibility under any lighting conditions for use in either competitive or recreational games of golf.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
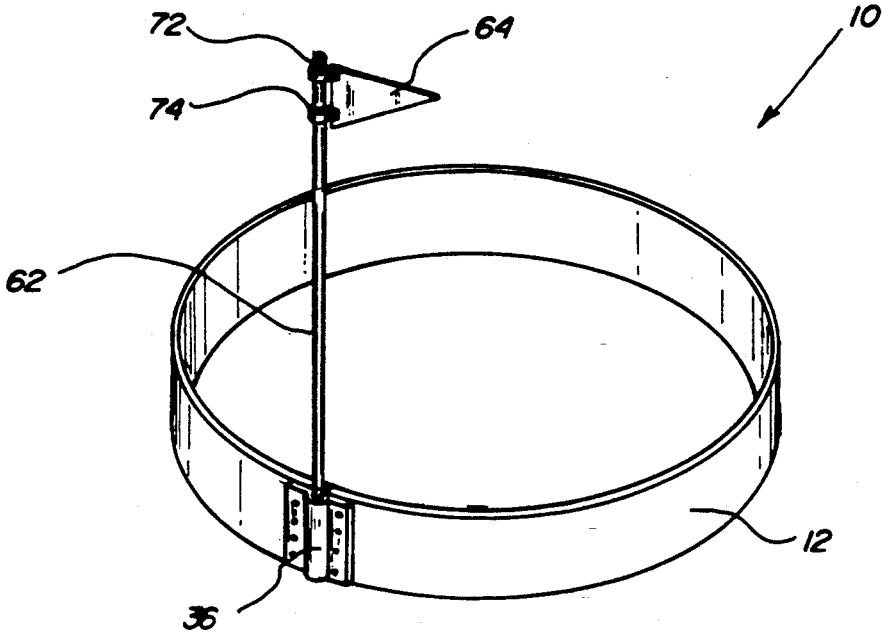
FIG. 1 is a perspective view of a first embodiment of the present invention.

With reference now to the drawings, and in particular to FIGS. 1-14 thereof, a new and improved chip shot practice ring embodying the principles and concepts of the present invention and generally designated by the reference numerals 10 and 83 will be described.

More specifically, and with particular reference to FIG. 1, a chip shot practice ring 10 of a first embodiment of the invention essentially comprises a substantially circular base member 12, a closure member 36 fastened to opposite ends of base member 12 for securing opposite end surfaces 16, 18 of the base member 12 in abutting relationship, a flag pole 62 having its lower end mounted in said closure member 36 and extending vertically upwardly from said base member 12 and said closure member 36, and a flag 64 fastened to the opposed, upper end of flag pole 62 by a pair of vertically spaced attaching clips 72, 74. Flag pole 62 may be fabricated from brightly colored aluminum rod to enhance its visibility.

Figure 5:
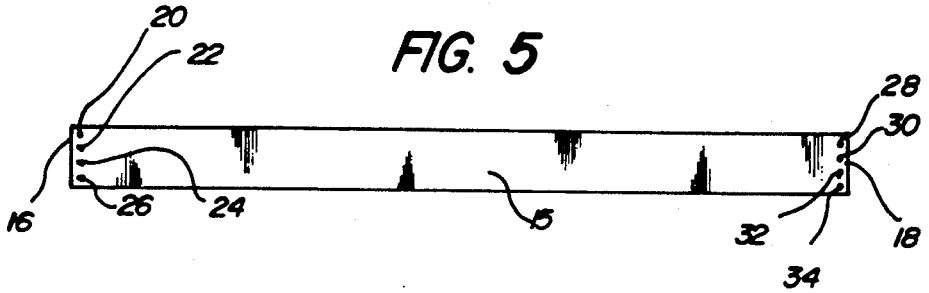
FIG. 5 is a front view of the rectangular strip of material used to form the base member.
Figure 6:
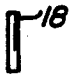
FIG. 6 is a side view of the rectangular strip of material used to form the base member.

With reference to FIGS. 5 and 6, base member 12 is constructed from a rectangular strip 15 of rigid, brightly colored polymeric material such as PVC foam and is provided with a plurality of vertically aligned rivet holes 20, 22, 24, 26 adjacent and parallel to an end surface 16, as well as a similar plurality of vertically aligned rivet holes 28, 30, 32, 34 adjacent and parallel to an end surface 18.

Figure 2:
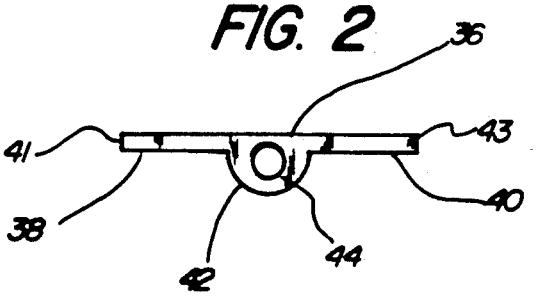
FIG. 2 is a plan view of the closure element used to join the abutting ends of the rectangular strip of material used to form the base member.
Figure 3:
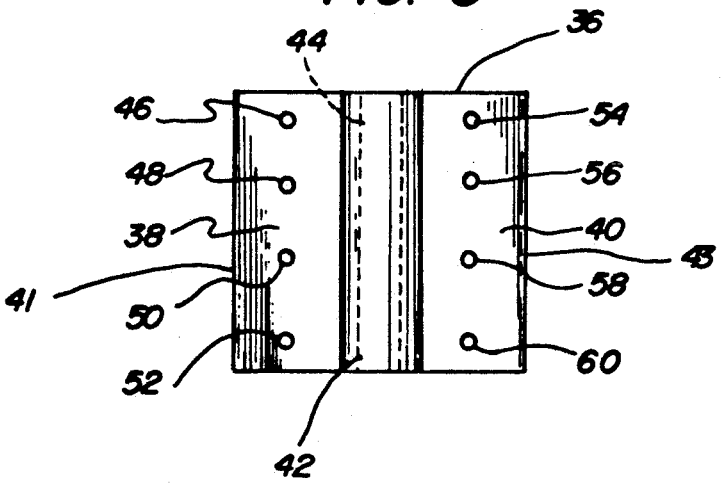
FIG. 3 is a front view of the closure member.
Figure 4:
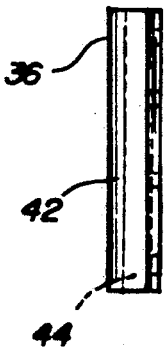
FIG. 4 is a side view of the closure member.

Referring now to FIGS. 2-4, closure member 36 is similarly composed of rigid, brightly colored polymeric material and comprises a pair of opposed flange portions 38, 40 and a substantially semi-circular enlarged portion 42 integral with said flange portions 38, 40 and positioned centrally therebetween. Extending through the center of enlarged portion 42 of closure member 36 is a vertically oriented hole 44 for receiving the lower end of a flag pole 62 which is dimensioned for easy assembly and disassembly with closure 36 and thus base member 12 to facilitate its transport, repair, or replacement. Flange portion 38 is provided with a plurality of centrally positioned, vertically aligned rivet holes 46, 48, 50, 52 adjacent and parallel to a side edge 41, while flange portion 40 is similarly provided with a plurality of centrally positioned, vertically aligned rivet holes 54, 56, 58, 60 adjacent and parallel to a side edge 43. Rivets (not shown) are secured in the aligned rivet holes 20/46, 22/48, 24/50, 26/52, 28/54, 30/56, 32/58, and 34/60 of base member 12 / and closure member 36, respectively, to tightly join the opposite ends of base member 12 to closure member 36 and thereby provide a rigid, substantially circular configuration for said base member 12.

Figure 7:
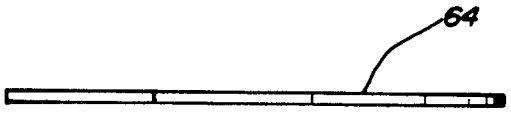
FIG. 7 is a plan view of the flag.
Figure 8:
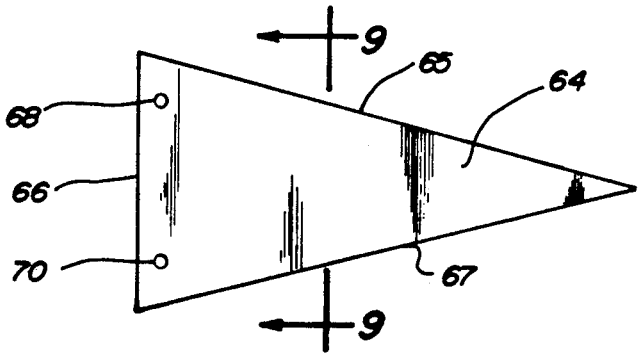
FIG. 8 is a front view of the flag.
Figure 9:
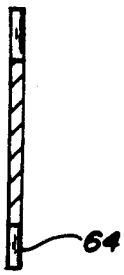
FIG. 9 is a cross-sectional view of the flag taken along line 9—9 in FIG. 8.
Figure 10:
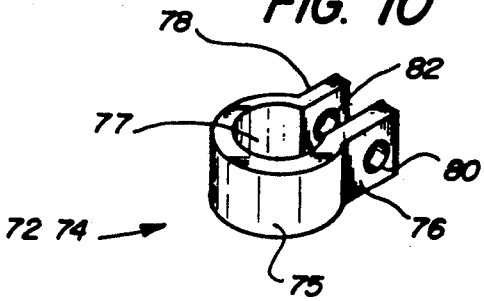
FIG. 10 is a perspective view of the flag-attaching clips.
Figure 11:
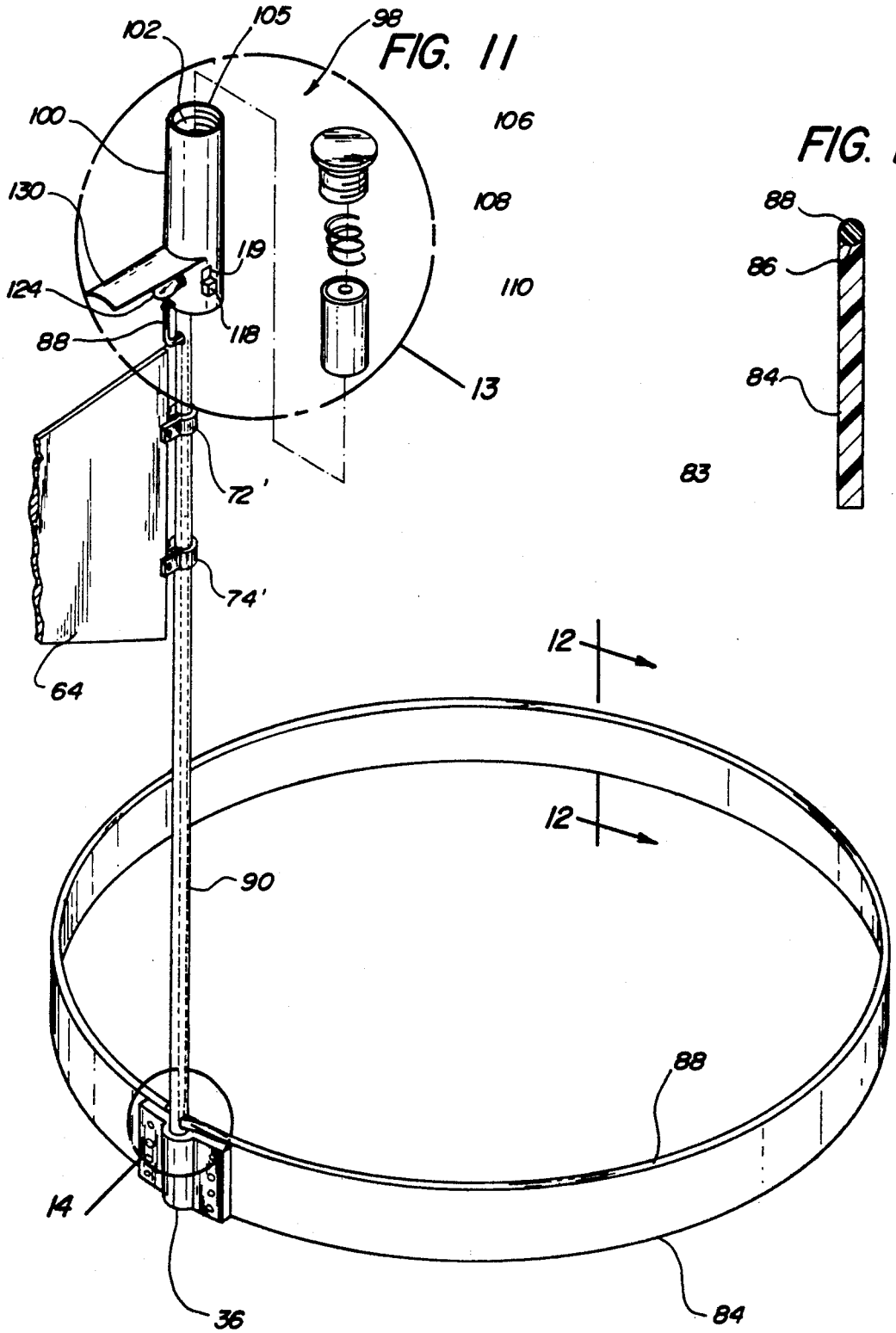
FIG. 11 is a perspective view, partly in an exploded illustration within circle 13, of a second embodiment of the present invention.
Figure 12:
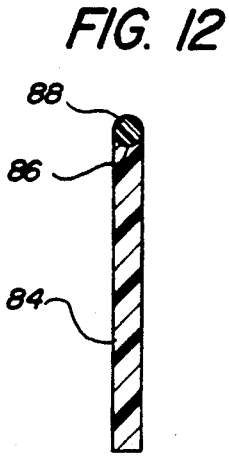
FIG. 12 is a cross-sectional view of the base member taken along line 12—12 in FIG. 11.
Figure 13:
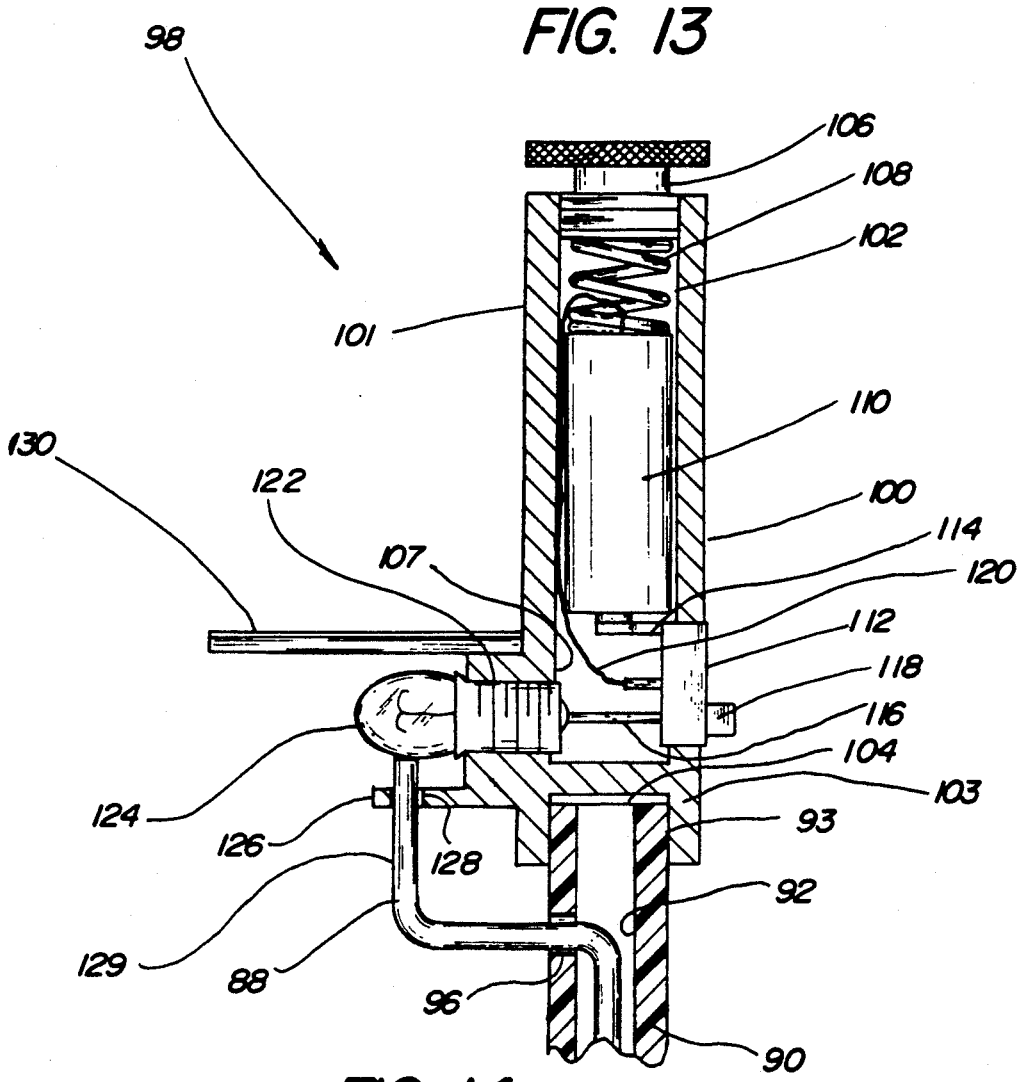
FIG. 13 is a cross-sectional view of those portions of the chip shot practice ring illuminating means, in their assembled condition, lying within circle 13 in FIG. 11.
Figure 14:
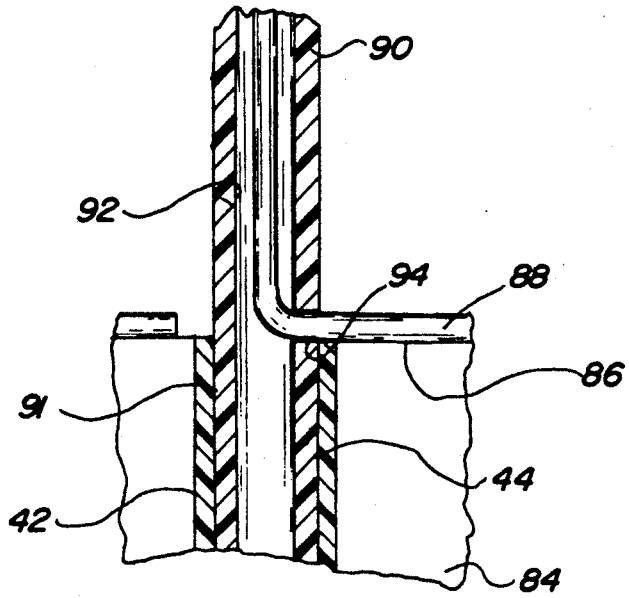
FIG. 14 is a cross-sectional view of those portions of the chip shot practice ring lying within circle 14 in FIG. 11.

As illustrated in FIGS. 7-9, flag 64 is triangularly shaped and has a pair of sides 65, 67 and a base 66. Positioned adjacent and parallel to base 66 are a pair of aligned rivet holes 68, 70. A pair of identical clips 72, 74 are provided to attach flag 64 to flag pole 62. Each attaching clip 72, 74 (FIG. 10) comprises a cylindrical portion 75 having a central bore 77, and a pair of opposed, parallel tabs 76, 78 which extend outwardly from said cylindrical portion 75. Each tab 76, 78 has a central rivet hole 80, 82, respectively. Rivet holes 80, 82 are axially aligned. Rivets(not shown) are secured in the aligned rivet holes 68/80, 82 and 70/80, 82 of flag 64 / and attaching clips 72, 74, respectively, to join said attaching clips 72, 74 to said flag 64 and tightly squeeze said clips 72, 74 around portions adjacent the upper end of flag pole 62 which are positioned in bores 77 of the clips 72, 74. Flag 64 may be constructed of brightly colored sheet aluminum, while attaching clips 72, 74 are constructed of brightly colored, rigid polymeric material. Flag 64 also has a hole number displayed thereon (not shown). Use of the disclosed brightly colored polymeric and aluminum materials for the components of chip shot practice ring 10 greatly enhances its visibility, portability, and resistance to material degradation such as rusting.

Further, and with particular reference to FIGS. 11–14, a chip shot practice ring 83 of a second embodiment of the invention comprises a substantially circular base member 84 similarly constructed from a rectangular strip of rigid PVC foam which is joined at its opposite ends by a rigid, brightly colored polymeric closure member 36' (structurally identical to closure member 36 in the first embodiment) riveted thereto in the identical structural manner as base member 12 of chip shot practice ring 10.

Base member 84 is provided with an upper annular edge surface 86 (FIG. 12) having an arcuate shape. A fiber optic cable 88 is fixed on said surface 86 and extends completely around said base member 84. Positioned in a vertically oriented hole 44' in closure member 36' is a lower end 91 (FIG. 14) of a vertically positioned, transparent polymeric flag pole 90 having a central bore 92. Lower end 91 of pole 90 is dimensioned for easy assembly and disassembly with closure member 36' and thus base member 84. Adjacent lower end 91 of pole 90 is an entry hole 94 for receiving cable 88 from base member 84. Cable 88 then extends upwardly within central bore 92 of vertically oriented pole 90 and exits therefrom through an exit hole 96 at an upper end 93 of said pole 90 for subsequent positioning and contact with a light source such as a bulb 124 of an illuminating assembly 98. Assembly 98 consists essentially of a brightly colored aluminum housing 100 having an upper bore 102 at an upper end 101 of the housing 100, and a lower bore 104 at an opposite lower end 103 of the housing 100 for receiving the upper end 93 of flag pole 90. Upper end 93 is dimensioned for easy assembly and disassembly with illuminating assembly 98. In this manner, the detachable connections between the lower 91 and upper 93 ends of the flag pole 90 and the closure 36' and base 84 members and the illuminating assembly 98, respectively, facilitate the breakdown and transport of the apparatus, as well as the repair or replacement of its component parts. Upper bore 102 has a threaded portion 105 (FIG. 11) at upper end 101. Positioned in upper bore 102 is a vertically descending arrangement of a threaded plug 106 threaded in portion 105, a compression spring 108, and a battery 110. Plug 106 and spring 108 press battery 110 into electrical connection with a conventional on/off switch 112 using joining elements 114, 120. Switch 112 has a manual operating tab 118 slidable in a slot 119 in the wall of housing 100. A further joining element 116 is provided for electrically connecting the previously noted light source, i.e. bulb 124, with switch 112. Bulb 124 is mounted in a threaded bore 122 extending laterally from a bottom end 107 of upper bore 102 adjacent lower end 103 of housing 100. Positioned below bulb 124 is a flange 126 extending laterally from the lower end 103 of housing 100 and substantially parallel to bulb 124 and threaded bore 122. Flange 126 has a guide hole 128 for guiding an upper end 129 of the fiber optical cable 88 which exits from hole 96 at the upper end 93 of pole 90 into contact with bulb 124. Accordingly, activation of the switch 112 to an "on" position causes illumination of bulb 124, cable 88 which contacts it, and therefore the transparent polymeric flag pole 90 and the periphery of base member 84 which has a portion of the lighted cable 88 mounted on its edge surface 86. Extending laterally from said housing 100 at a position directly above and substantially parallel to bulb 124 is a reflective metal shade 130 to direct light downwardly and thus illuminate a flag 64'. Flag 64' is mounted on pole 90 at a location adjacent to and below its upper end 93 by means of a pair of attaching clips 72',74'. In this manner, the light from a single bulb 124 illuminates both the flag 64', the flag pole 90, cable 88, and the periphery of base member 84, to thereby provide a practice ring 83 of simple construction having maximum visibility to the practicing golfer under minimal lighting conditions. Flag 64' and the attaching clips 72',74' are structurally identical to flag 64 and clips 72, 74 of the first embodiment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A portable chip shot practice ring comprising:

a substantially circular base member having a pair of opposed ends, each opposed end having an end surface;

a closure member secured to each of said base member ends for permanently joining said end surfaces in abutting relationship;

fastener means for securing said closure member to said base member ends;

a flag pole having opposed upper and lower ends;

first means for detachably mounting said lower end of said flag pole in a vertical orientation in said closure member;

a flag; and second means for attaching said flag to said flag pole at a position adjacent to said upper end of said flag pole.

2. The portable chip shot practice ring of claim 1, wherein said base member is formed from a rectangular sheet of brightly colored and rigid polymeric material and is provided with a plurality of first fastener holes adjacent to each of said end surfaces.

3. The portable chip shot practice ring of claim 2, wherein said rigid polymeric material is PVC foam.

4. The portable chip shot practice ring of claim 2, wherein said closure member includes a pair of opposed flange portions, each of said flange portions overlying each of said base member ends and end surfaces, each of said flange portions having a plurality of second fastener holes axially aligned with said first fastener holes, said fastener means including a fastener fixedly positioned in each of said aligned first and second holes to permanently join said base and closure members, and a substantially semi-circular enlarged portion integral with and positioned centrally between said flange portions; and wherein said first means for detachably mounting said lower end of said flag pole in said vertical orientation in said closure member is a vertically oriented hole extending through said enlarged portion for receiving said lower end of said flag pole.

5. The portable chip shot practice ring of claim 1, wherein said closure member is composed of brightly colored polymeric material.

6. The portable chip shot practice ring of claim 1, wherein said flag pole is formed from brightly colored aluminum rod.

7. The portable chip shot practice ring of claim 1, wherein said flag is triangular and composed of brightly colored sheet aluminum, said flag having a base and a pair of spaced, fastener-receiving holes adjacent to said base.

8. The portable chip shot practice ring of claim 7, wherein said second means for attaching said flag to said flag pole includes a pair of brightly colored polymeric clips, each of said clips having a cylindrical portion with a central bore positioned around a portion of said flag pole adjacent said upper end thereof, a pair of opposed, parallel tabs extending outwardly from said central portion, each tab having a central fastener hole, said fastener holes being axially aligned, wherein said tabs of each clip overlie opposite sides of said flag base, respectively, in a manner wherein said flag base holes and said tab holes are aligned, and a pair of fasteners fixedly positioned in said aligned holes to tightly squeeze said attaching clips around said flag pole to permanently secure said flag thereon.

9. The portable chip shot practice ring of claim 1, wherein said flag pole is composed of transparent polymeric material and has a central bore extending therethrough;

and further comprises an illuminating assembly detachably positioned on said upper end of said flag pole, and light transmission means positioned within said central bore of said flag pole and around the periphery of said base member for lighting said flag, flag pole, and base member.

10. The portable chip shot practice ring of claim 9, wherein said illuminating assembly includes:

a brightly colored aluminum housing, said housing having an upper end and an opposed lower end, an upper bore at said upper end of said housing, said upper bore having a threaded portion at said upper end of said housing, a lower bore at said lower end of said housing, said lower bore detachably receiving said upper end of said flag pole therein;

a battery positioned in said upper bore;

a compression spring positioned in said upper bore above and in contact with said battery;

a threaded plug engaged in said threaded portion and positioned above and in contact with said compression spring for resiliently pressing said battery into said upper bore;

a threaded bore extending laterally from a bottom end of said upper bore;

a light bulb threaded in said threaded bore and extending outwardly from said lower end of said housing;

switch means positioned below said battery in a position adjacent said bottom end of said upper bore and spaced from said threaded bore for selectively actuating said light bulb with said battery;

joining means in said upper bore for electrically connecting said battery and said light bulb to said switch means;

a flange extending laterally from said lower end of said housing and positioned below and substantially parallel to said light bulb and said laterally extending threaded bore;

a guide hole extending vertically through said flange and positioned directly below said light bulb; and a reflective metal shade extending laterally from said housing at a position above and substantially parallel to said light bulb for directing light from said bulb downwardly onto said flag to illuminate it;

wherein said base member has an upper annular edge with an arcuate shape which extends completely around its periphery;

wherein said flag pole has an entry hole intersecting said central bore thereof, said entry hole being positioned at said lower end of said flag pole adjacent said upper annular edge of said base member, and an exit hole intersecting said central bore at said upper end of said flag pole at a position adjacent said lower end of said illuminating assembly housing; and wherein said light transmission means positioned within said central bore of said flag pole and around said periphery of said base member is a fiber optic cable fixedly positioned on said arcuately shaped annular edge of said base member, said cable extending through said flag pole entry hole, said central bore and said exit hole thereof, and then through said flange guide hole into contacting engagement with said light bulb to light said cable and therefore said flag pole and said base member upon placement of said switch to an "on" position.

* * * * *